United States Patent [19]

Rich, III et al.

[11] Patent Number: 4,507,640

[45] Date of Patent: Mar. 26, 1985

[54] HIGH FREQUENCY TRANSFORMER

[75] Inventors: Edward L. Rich, III, Arnold, Md.; Yucel Y. Yalim, Coral Springs, Fla.

[73] Assignee: Westinghouse Electric Co., Pittsburgh, Pa.

[21] Appl. No.: 444,637

[22] Filed: Nov. 26, 1982

[51] Int. Cl.[3] ..... H01F 27/28

[52] U.S. Cl. ..... 336/223; 336/83; 336/232

[58] Field of Search ..... 336/83, 223, 232

[56] References Cited

U.S. PATENT DOCUMENTS 2,692,934 10/1954 Williamson ..... 336/223 X

FOREIGN PATENT DOCUMENTS 1230874 12/1966 Fed. Rep. of Germany ..... 336/83

2406353 11/1974 Fed. Rep. of Germany ..... 336/83

4529950 12/1967 Japan ..... 336/83

*Primary Examiner*—A. D. Pellinen

*Assistant Examiner*—Susan A. Steward

*Attorney, Agent, or Firm*—J. B. Hinson

[57] ABSTRACT

A high frequency, transformer capable of operating at high power levels is disclosed. Conductive ribbons including end (terminal) sections which permit the terminal leads of a plurality of windings to be extended from the windings in an overlapping relationship and in the selected order is utilized for the windings. Preferably, the core is formed of a material having low eddy current losses and characteristics permitting the core to be molded such that the windings are substantially surrounded by the core with the exception of small openings through which the leads extend.

4 Claims, 14 Drawing Figures

FIG. 11
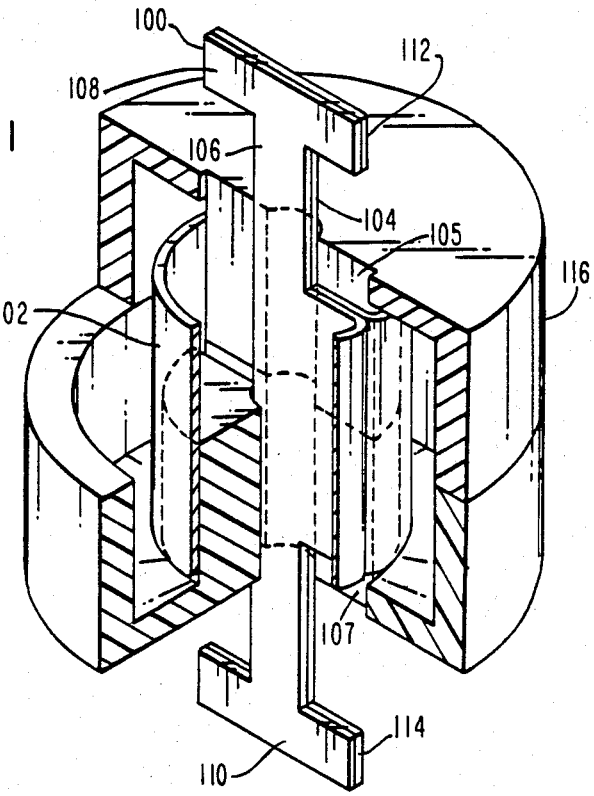
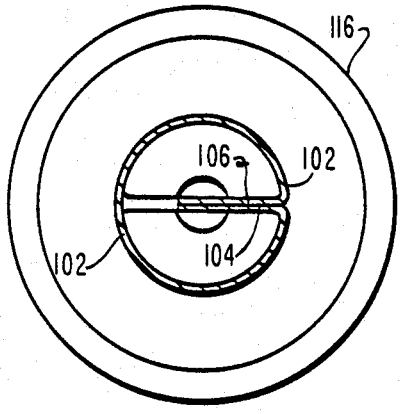
FIG. 12
FIG. 13
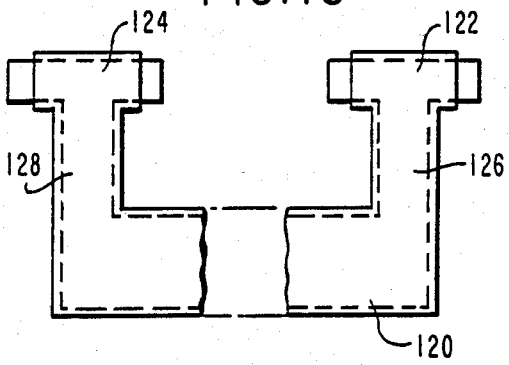
FIG. 14
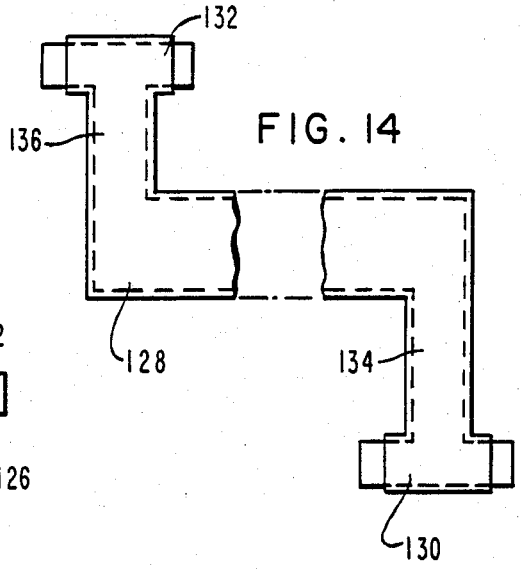

HIGH FREQUENCY TRANSFORMER

BACKGROUND OF THE INVENTION

1. Field of the Invention

The invention relates to transformers and more specifically to high frequency, high current transformers utilizing ribbon conductors as the windings.

2. Description of the Prior Art

Prior art high frequency transformers were limited in currrent capability due to the resistance of the wire utilized as conductors at high (RF) frequencies as well as by a stray inductance associated with the input leads and the windings. Additionally, some of these effects such as the stray inductance associated with the leads tended to be variable because the coupling between the leads as well as from the leads to other structures in the vicinity was rather unpredictable.

The net external lead loop area, resulting from leads not emerging in preferred positions, often caused a limiting amount of leakage inductance (100's of nanohenries).

SUMMARY OF THE INVENTION

The preferred embodiment of the invention utilizes a magnetic core formed in at least two sections, the sections defining a magnetic path which surrounds the windings except for openings through which the leads extend. Conductive ribbons are utilized as windings and include end sections which permit the leads associated with a plurality of windings to be brought out in a preferred order and such that they are in a layered arrangement. (Layered arrangement is intended to indicate that the leads are stacked with the edges of the ribbons being substantially parallel to each other with insulating layers separating the ribbons from each other.)

In an alternate embodiment, the magnetic core includes an opening in the center through which the ribbon leads extend.

BRIEF DESCRIPTION OF THE DRAWINGS

FIG. 11 is an isometric view of an alternate embodiment of a transformer comprising the invention;

FIG. 12 is a cross-section view of the transformer illustrated in FIG. 11; and FIGS. 13 and 14 are drawings of alternate ribbons which may be used as windings.

DETAILED DESCRIPTION OF THE PREFERRED EMBODIMENT

Figure 1:
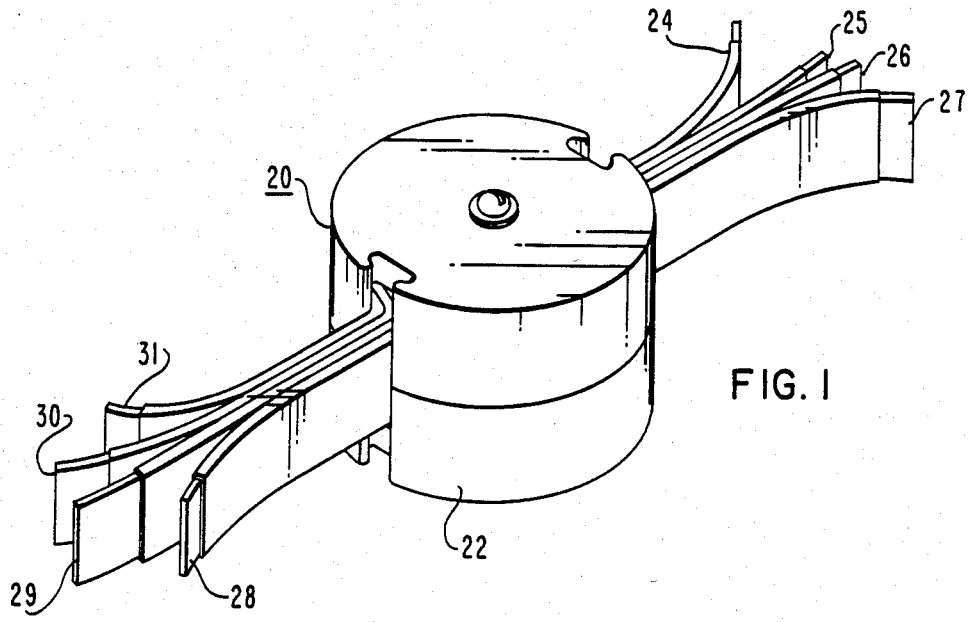
FIG. 1 is a drawing illustrating a completed transformer in accordance with the invention.

FIG. 1 is a drawing illustrating a transformer having four independent windings in accordance with the preferred embodiment of the invention. The preferred embodiment includes a two-piece pot core 22. Continuous electrically conductive ribbons are utilized as windings with the ends of the ribbons 24–31 serving as input connections (leads) to the transformer 20. Other winding configurations may require more or less input connections.

Figure 2:
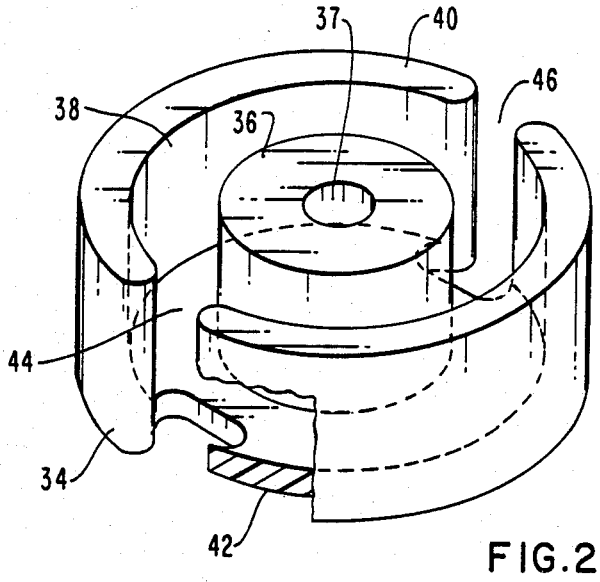
FIG. 2 is an isometric drawing illustrating one section of the two section core utilized by the transformer which is the subject of the invention.

FIG. 2 is an isometric view of one of the two identical sections comprising the core 22 of the embodiment illustrated in FIG. 1. In the art, transformer cores of the type illustrated in FIG. 2 are known as pot cores and can be purchased commercially from a variety of suppliers. For high frequency use, such as the transformers which are the subject of this application, the cores should be composed of a magnetic material having a low hysteresis and eddy current losses and high bulk resistivity. Suitable magnetic materials for such cores are generically called ferrites in the art.

Structurally, the core 34 includes a cylindrical central portion 36 having an opening 37 in the center thereof. Surrounding the central portion 36 is a groove 38 bounded on the outer edge by a wall portion 40. At one end the outer wall 40 and the central portion 36 are joined by a disc-like portion 42 to complete the structure of the core. Two openings 44 and 46 are provided in the outer wall 40 for leads to extend from the completed transformer 22. Cores of the type illustrated in FIG. 2 ae suitable for use in all embodiments of the invention in which the leads extend outward radially through the outer wall of the core 34. Other core configurations are also usable provided a suitable magnetic path is maintained.

Various embodiments of the ribbons used to wind the transformers having leads extending through the openings, 44 and 46 are illustrated in FIGS. 3–7, 13 and 14. The specific ribbon used depends on the transformer configuration.

Figure 3:
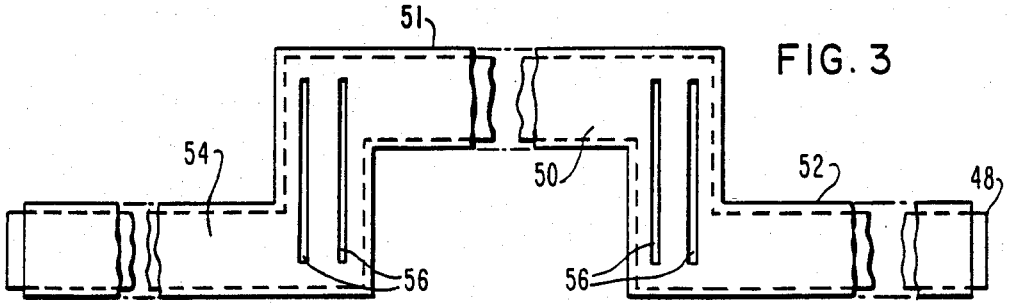
FIGS. 3–7 are electrically conductive ribbons utilized as windings in various embodiments of the invention.

More specifically, FIG. 3 illustrates a first embodiment of the electrically conductive ribbon. The ribbon includes a central portion 50 which has two substantially parallel edges and is insulated electrically on at least one side thereof by an electrically insulating layer 51. Attached to the central portion 50 and offset therefrom by a selected distance are two (terminal) end portions 52 and 54, also having substantially parallel edges. End portions 52 and 54 are joined to the central portion 50 by two substantially identical sections each having slots, 56, parallel to the edges thereof. Although the end portions 52 and 54 are illustrated as offset from the central portion 50 in the same direction, they may be offset in opposite directions.

Figure 4:
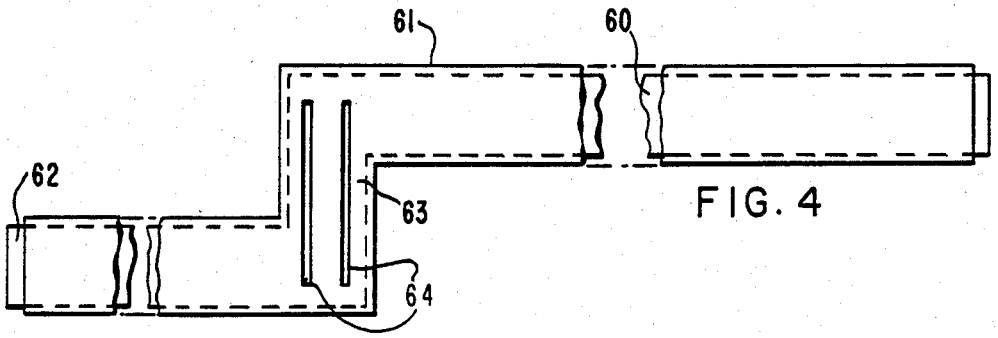

A second electrically conductive ribbon which includes a first portion 60 having parallel edges and a second portion 62 is illustrated in FIG. 4. The first and second portion 60 and 62 are joined are jointed by a slotted portion 63 which includes parallel slots 64. An electrically insulating layer 61 covers the ribbon. This electrically conductive ribbon is essentially identical to the one illustrated in FIG. 3 except that it only includes one offset or end portion.

Figure 5:
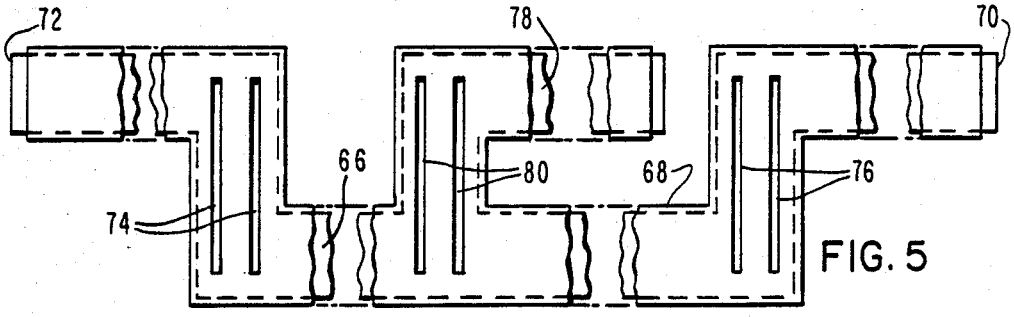

An embodiment of the ribbon useful in winding center tapped single turn transformers in accordance with the invention is illustrated in FIG. 5. This embodiment includes two central portions 66 and 68, each having substantially parallel edges and an insulating layer 61 on at least one side thereof. Two end (terminal) sections 70 and 72 are connected to the central portions by a region which includes parallel slots 74 and 76. Intermediate to the first and second end portions 70 and 72 is a third end (terminal) section 78 which is coupled to the junction of central portions 66 and 68 by a third connecting section which also includes parallel slots 80. If this ribbon is to be used to form a center tapped winding, the central portions 66 and 69 will be of equal length. If the terminal formed by the central end (terminal) section 78 this ribbon is located at a point other than the center, portions 66 and 68 will be of unequal length resulting in the winding being taped at a point other than its center.

The ribbons discussed above may be modified such that the end portions are positioned on opposite sides of the central portion. Such a modification of the ribbons may require that the ribbons be pre-wound and then positioned in the core.

Figure 6:
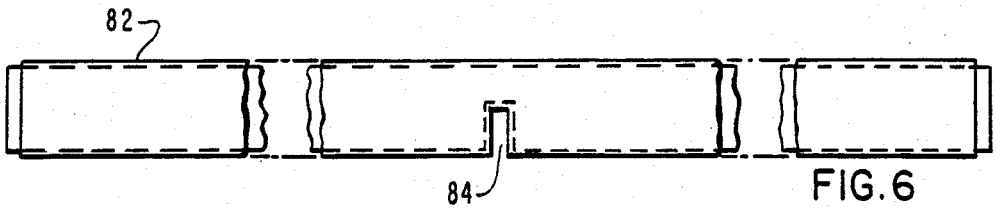
Figure 7:
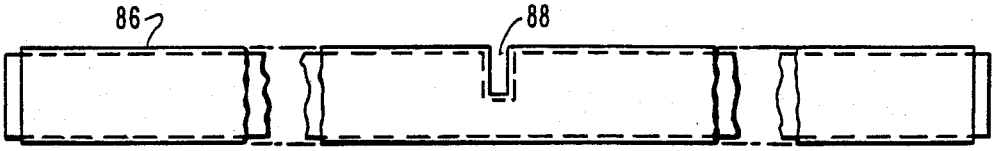

Two electrically conductive ribbons which can be utilized to wind a transformer in which the leads come out in order such that two adjacent terminals can be connected to form a center tapped winding, are illustrated in FIGS. 6 and 7. More specifically, a ribbon 82 having substantially parallel edges and a notch 84 in the lower edge thereof is illustrated in FIG. 6. A complementary ribbon 86 having a notch 88 in the upper edge thereof is illustrated in FIG. 7. These two ribbons can be positioned such that the narrow portion of fibbon 82 is in the notch 88 of ribbon 86 and the narrow portion of ribbon 86 is in the notch 84 or ribbon 82. The two ribbons 82 and 86 are then simultaneously wound on the core such that the two adjacent central terminals can be connected together to form a center tapped winding. Electrically insulating layers 83 and 87 prevent electrical connections between ribbons 82 and 86 except at the center tap.

Figure 8:
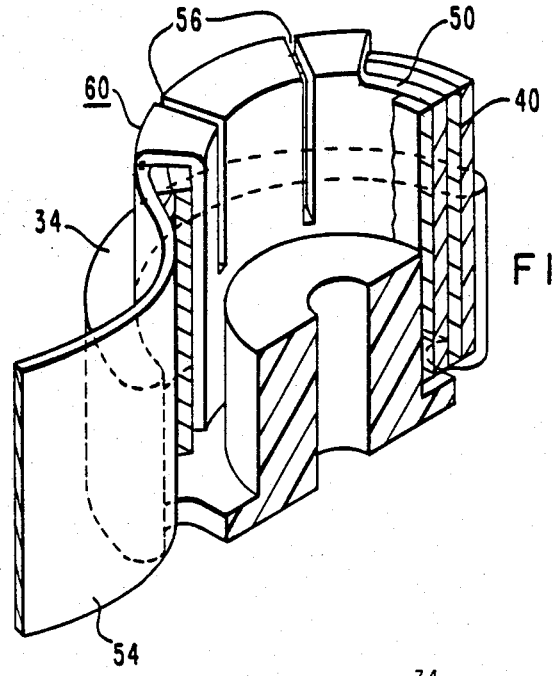
FIG. 8 is a partial isometric drawing illustrating the use of the end sections of the electrically conductive ribbons.

FIG. 8 is a fragmentary view of a core 34 of the type illustrated in detail in FIG. 2 and a portion of a winding illustrating how the ribbons having offset terminal portions as illustrated in FIGS. 3, 4 and 5 are utilized to form transformer windings. More specifically, winding 90 includes a ribbon of the type illustrated in FIG. 3. The same reference numerals used to identify the parts of the ribbon in the above discussion will be used in this figure for clarity. For example, the end (terminal) portion 54 of the ribbon extends through the opening in the outer wall of the core 34 to form a lead to the winding. The slots 56 in the connecting portion permit the central portion 50 of the ribbon to be on the interior of the winding 90 and the ribbon to be folded over to the outside of the winding and positioned such that it extends through the opening in the core 34 to form a convenient terminal lead. The other end portions of the ribbons illustrated in FIGS. 3, 4 and 5 can be similarly utilized to form connections to windings similarly positioned in the core 34. The order in which the windings emerge from the pot cores to form leads can be controlled by the order in which the connection portions are folded over to form the leads. This permits the leads to be brought out in any convenient order. Of course the ribbon illustrated in FIG. 3 can be utilized only on the outermost winding with the end not having an offset end portion being used as the final end of the outermost winding.

The slotted portion 56 of the ribbon 50 is distorted in FIG. 8 because the inner and outer circumferences of the winding 90 are different. Slots 56 provide sufficient flexibility to permit the ribbon 54 to be folded over without unreasonable distortion. Although the electrically conductive ribbons illustrated only two slots, a different number of slots can be used.

Figure 9:
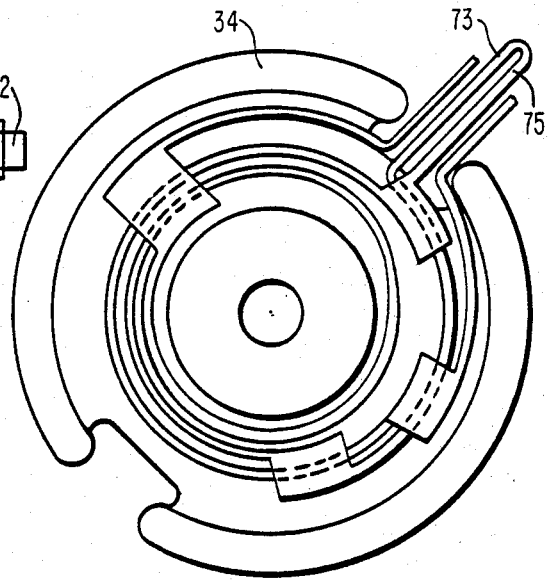
FIG. 9 is a top view of a completed winding.

FIG. 9 is a top view of one half of the core 20 having a winding composed of two ribbons of the type illustrated in FIG. 3 wound with adjacent leads 73 and 75 connected together to conveniently form a single tapped winding. A second center tapped winding for the secondary can be similarly constructed if desired. Other windings can also be added, as required. Such additional windings are not illustrated for purposes of convenience.

Figure 10:
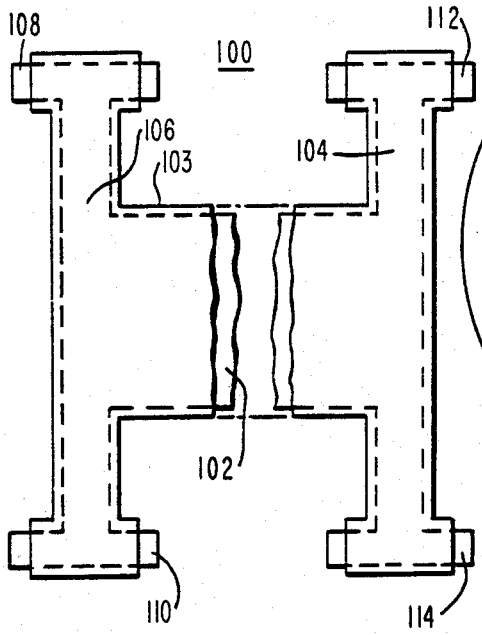
FIG. 10 is a drawing illustrating an electrically conductive ribbon utilized to wind transformers having leads extending through the center of the core.

FIG. 10 illustrates an alternate embodiment of a ribbon 100 which may be used to wind transformers such that the leads emerge through an opening in the center of the transformer core. More specifically, ribbon 100 includes a central portion 102 having substantially parallel edges and an insulating layer 103 on at least one side thereof. The ends of the central portion 102 connects to end portions 104 and 106, each having substantially parallel edges and positioned at substantially 90° with respect to the central portion 102. Each of the end sections 104 and 106 terminates in tabs 108–114. The use of this ribbon to form a typical winding of a transformer is illustrated in FIG. 11.

FIG. 11 is an isometric view with partial sections illustrating the use of the ribbon 100 to form a winding of a transformer. The transformer illustrated in FIG. 11 includes a cup core 116, very similar to the previous embodiments. The central portion 102 of the ribbon winds around the cylindrical central portion of the core 116 and extends through slots 105 and 107 in the central portion of the core 115. The ends portions 106 and 104 of the ribbon 100 extend radially out through slots 105 and 107 in the core 116 such that the conductive end tabs 108–114 extend beyond the top and bottom edges of the core 16. Although only one ribbon is illustrated in FIG. 11, additional windings can be similarly added to complete the transformer.

For further clarity, a cross-section along the mating surface of the two sections of the core 116 of the transformer illustrated in FIG. 11 is shown in FIG. 12. This figure clearly illustrates the position of the central portion 102 of the ribbon 100 as well as the end portions 104 and 106 extending through the slots in the central portion in the core.

Alternate ribbon configurations useful in winding transformers of the type illustrated in FIG. 11 are illustrated in FIGS. 13 and 14. More specifically, the ribbon illustrated in FIG. 13 includes a central portion 120 and two end tabs 122 and 124 connected to the central portion 120 by two connecting sections 126 and 126. This ribbon can be used to form a winding on a core of the type illustrated at reference number 116, FIG. 11 with both terminals extending to the top or bottom of the core 116. (It is arbitrary which surface is considered to be the top or bottom of core 116.)

A further alternate ribbon suitable for forming windings on a core of the type illustrated at reference number 116 of FIG. 11 is illustrated in FIG. 14. This ribbon includes a central portion 128 and two end terminals 130 and 132. The end terminals 130 and 132 are coupled to the central portion 128 by first and second connecting sections 134 and 136. This ribbon can be used to form windings on the core 116 such that terminals 130 and 132 respectively extend through the top and bottom surfaces of the core 116.

Many additional modifications can be made to the conductive ribbons specifically discussed. For example, two or more ribbons can be separated by an insulating layer and laminated together and wound on the core at the same time. Also, the central portion 102 of the ribbon illustrated in FIG. 10 can be split along a horizontal line to form two windings with the terminals of on winding extending through the top surface of the core and the terminals of the second winding extending through the bottom surface of the core.

We claim:

1. A transformer comprising in combination:

(a) a core, said core including first and second sections each having a first substantially flat end and a second end, said second end including a groove surrounding a central portion and an outer portion separated from said central portion by said groove, said second end of said first and second sections adjacently positioned defining a closed magnetic path;

(b) a plurality of windings each encircled by said closed magnetic path, each winding comprising a substantially flat electrically conductive ribbon selectively covered with an electrically insulating layer, each ribbon having a central portion, a connecting portion and a terminal portion, said connecting portion joining said central and said terminal portions such that said terminal portion is substantially parallel to said central portion and off-set thereform permitting a plurality of said ribbons to be wound such that the edges of said plurality of ribbons are in substantially the same plane to form windings with said connecting portions being folded over the edge of said windings with said terminal portions emerging from said windings in a selected order such that the edges of said terminal portions are in substantially the same plane.

2. A ribbon for use as a winding for a transformer comprising:

(a) a central portion having substantially straight and parallel edges;

(b) at least one terminal portion having substantially straight and parallel edges;

(c) at least one interconnecting portion coupling said central portion and said at least one terminal portion together such that said edges of said central and edge portions are substantially parallel to each other thereby permitting a plurality of said ribbons to be wound such that the edges of said ribbons are in substantially the same plane to form a winding with said interconnecting portion being folded over the edge of said winding such that said terminal portions emerge from said winding in a selected order.

3. A ribbon for winding a transformer comprising:

(a) first and second end portions each having substantially straight and parallel edges;

(b) a central narrow portion, formed by a notch in said ribbon, having a width less than said end portion permitting at least two of said ribbons to be interleaved by positioning the narrow portion of said first winding in the notch in said second winding and by also positioning the narrow portion of said second winding in the notch in said first winding such that when said ribbons ae used to form a transformer winding the ends of said windings can be interconnected to form a single center tapped winding with the center terminal of said center tapped winding being positioned between the end terminals of said center tapped winding.

4. A transformer comprising:

(a) a magnetic structure having two substantially identical sections each having a substantially flat first end, a second end including a groove surrounding a central portion and an outer portion separated from said central portion by said groove, one edge of said outer portion defining the outer edge of said groove such that when said second end of said two sections are positioned adjacent each other said central and outer portions are in contact, thereby forming a cavity surrounded by a magnetic circuit formed by said first and second substantially identical sections;

(b) a first electrically conductive ribbon having the surface thereof selectively covered with an electrically insulating layer, said electrically conductive ribbon also including a central portion, a terminal portion and a connecting portion joining said central and terminal portions such that said terminal portions is off-set from said central portions with the edges of said central and terminal portions substantially parallel;

(c) a second electrically conductive ribbon having the surface thereof selectively covered with an electrically insulating layer, said electrically conductive ribbon also including a central portion, a terminal portion and a connecting portion joining said central and terminal portions such that said terminal portions is off-set from said central portions with the edges of said central and terminal portions are substantially parallel; with:

(d) said first and second electrically conductive ribbons being wound such that the edges of said central portions of said first and second electrically conductive ribbons are in substantially the same plane to form a winding with said connecting portions being folded over the edge of said winding such that when said winding is positioned in said cavity said end portions emerge through said outer portions of said magnetic structure in a selected order.

* * * * *